US007380923B2

(12) United States Patent
Matsuda et al.

(10) Patent No.: US 7,380,923 B2
(45) Date of Patent: Jun. 3, 2008

(54) LIQUID SUPPLY APPARATUS

(75) Inventors: Masashi Matsuda, Hachioji (JP); Noriko Yokoyama, Hachioji (JP)

(73) Assignee: Olympus Corporation, Tokyo (JP)

( * ) Notice: Subject to any disclaimer, the term of this patent is extended or adjusted under 35 U.S.C. 154(b) by 421 days.

(21) Appl. No.: 10/947,527

(22) Filed: Sep. 22, 2004

(65) Prior Publication Data

US 2005/0068383 A1 Mar. 31, 2005

(30) Foreign Application Priority Data

Sep. 26, 2003 (JP) ..... 2003-335469

(51) Int. Cl.
*B41J 2/175* (2006.01)

(52) U.S. Cl. ..... 347/85

(58) Field of Classification Search ..... 347/85, 347/7, 84

See application file for complete search history.

(56) References Cited

U.S. PATENT DOCUMENTS 6,082,851 A * 7/2000 Shihoh et al. ..... 347/85

FOREIGN PATENT DOCUMENTS

JP 2000-309109 A 11/2000

* cited by examiner

*Primary Examiner*—Stephen D. Meier
*Assistant Examiner*—Geoffrey Mruk
(74) *Attorney, Agent, or Firm*—Frishauf, Holtz, Goodman & Chick, P.C.

(57) ABSTRACT

An overflow liquid pipe is disposed in such a manner as to pass a liquid which has overflowed from a first container flowing to a second container. The overflow liquid pipe is provided with a pressurizing pipe. A liquid removing unit pressurizes the interior of the overflow liquid pipe through the pressurizing pipe to remove liquid from the overflow liquid pipe.

15 Claims, 2 Drawing Sheets

LIQUID SUPPLY APPARATUS

CROSS-REFERENCE TO RELATED APPLICATIONS

This application is based upon and claims the benefit of priority from prior Japanese Patent Application No. 2003-335469, filed Sep. 26, 2003, the entire contents of which are incorporated herein by reference.

BACKGROUND OF THE INVENTION

1. Field of the Invention

The present invention relates to an image forming apparatus, for example, of an ink jet system, and a liquid supply apparatus having a reservoir tank to accommodate an ink liquid supplied from an ink tank, and provided with a countermeasure to remove the ink liquid remaining in a pipe to feed the ink liquid which has overflowed the reservoir tank to an overflow tank.

2. Description of the Related Art

An image forming apparatus of an ink jet system has an ink tank which accommodates an ink liquid. The ink liquid accommodated in the ink tank is supplied to an ink distribution unit through a reservoir tank. The ink liquid supplied to the ink distribution unit is supplied to a plurality of ink heads. The plurality of ink heads spout the ink liquids. An image forming medium such as a recording sheet is conveyed to a position facing the plurality of ink heads at a predetermined speed. Therefore, when the respective ink liquids spouted from the plurality of ink heads are shot on the image forming medium, an image is formed on the image forming medium.

In the image forming apparatus, for example, the ink liquid sometimes overflows the reservoir tank. In the image forming apparatus, a countermeasure for coping with an unusual operation that the ink liquid overflows the reservoir tank is taken. In one example of the countermeasure, an overflow liquid pipe is connected between the reservoir tank and an overflow tank, and the ink liquid which has overflowed the reservoir tank is fed to the overflow tank through the overflow liquid pipe.

At a usual time, when a liquid level height of the ink liquid in the reservoir tank is in the vicinity of an inflow port of the overflow liquid pipe, the ink liquid adheres or gets detached with respect to the inflow port of the overflow liquid pipe. When the ink liquid adheres or gets detached with respect to the inflow port of the overflow liquid pipe, a film of the ink liquid is formed on the inflow port by surface tension or the like. In a worst case, the film of the ink liquid formed on the inflow port sometimes solidifies.

The liquid level height of the ink liquid in the reservoir tank moves upwards or downwards because of a balance between a supply amount of the ink liquid from the ink tank and a supply amount of the ink liquid into the plurality of ink heads. When the liquid level height of the ink liquid moves upwards or downwards, the inflow port of the overflow liquid pipe is sometimes immersed in the ink liquid. In this state, the ink liquid sometimes enters the overflow liquid pipe, and remains as such in the overflow liquid pipe.

In Jpn. Pat. Appln. KOKAI Publication No. 2000-309109, a technique has been described in which a main discharge pipe is opened to the atmosphere to thereby return the ink liquid which has gotten into the discharge pipe to a sub-tank.

BRIEF SUMMARY OF THE INVENTION

According to a major aspect of the present invention, there is provided a liquid supply apparatus comprising: a first container which receives supply of a liquid to accommodate the liquid and which supplies the accommodated liquid to another component; an overflow liquid pipe is to flow the liquid which has overflowed the first container; a second container to accommodate the liquid flowing through the overflow liquid pipe; a pressurizing pipe is connected to the overflow liquid pipe; and having a liquid removing unit which performs the pressurizing inside the overflow liquid pipe through the pressurizing pipe to removing the liquid existing in the overflow liquid pipe.

DETAILED DESCRIPTION OF THE INVENTION

A first embodiment of the present invention will be described hereinafter with reference to the drawings.

Figure 1:
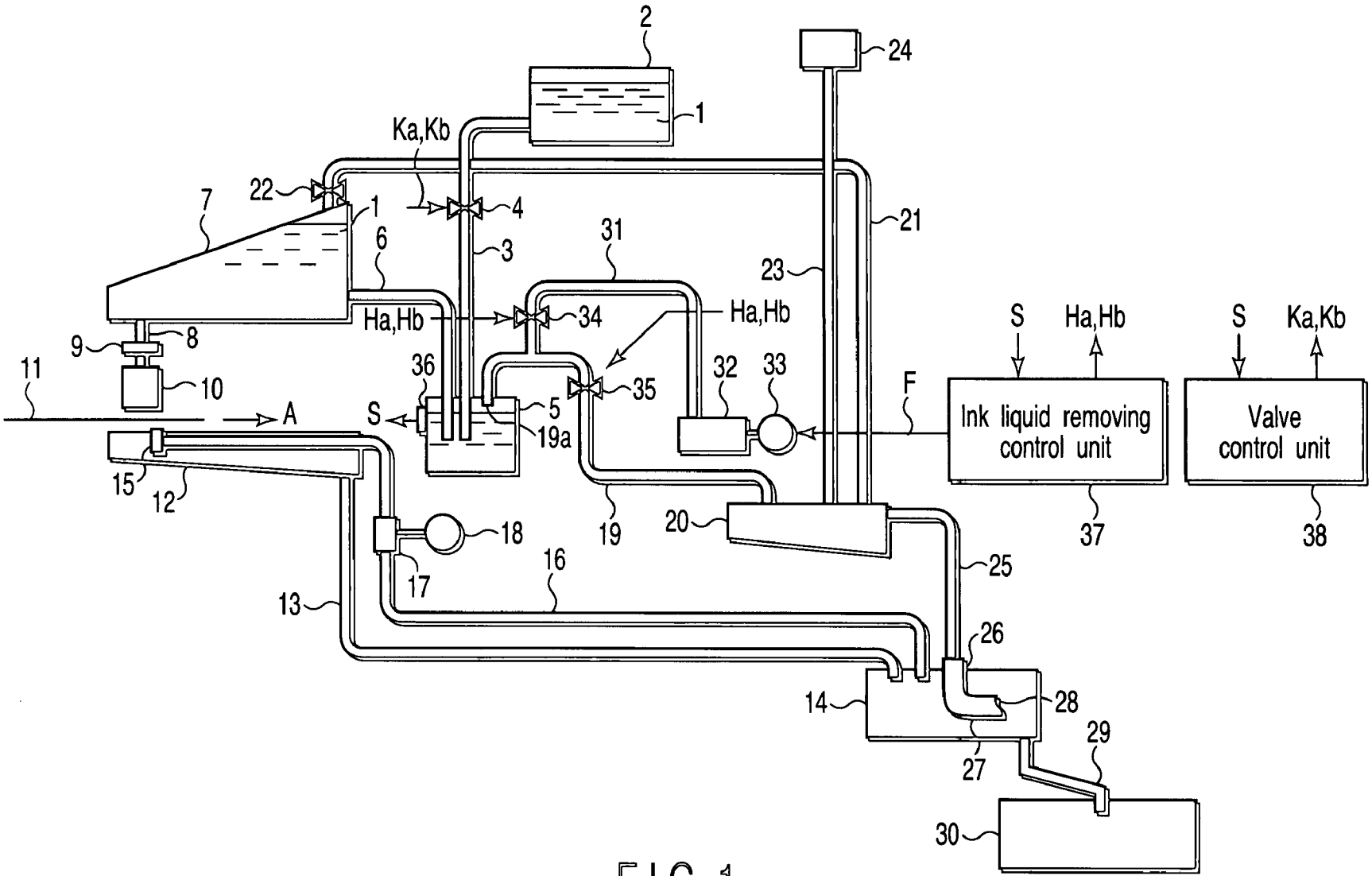
FIG. 1 is a constitution diagram showing an image forming apparatus to which a first embodiment of a liquid supply apparatus according to the present invention is applied.

FIG. 1 is a constitution diagram of an image forming apparatus of an ink jet system, to which a liquid supply apparatus is applied. The image forming apparatus comprises a plurality of ink tanks 2 which accommodate ink liquids 1 of colors of black (K), cyan (C), magenta (M), and yellow (Y). FIG. 1 shows one ink path with respect to the ink liquid 1 of one color in consideration of complexity in drawing.

A lower part of the ink tank 2 is connected to a first ink supply pipe 3. The first ink supply pipe 3 is halfway curved downwards and extended. An opening/closing valve 4 is disposed on the first ink supply pipe 3.

A reservoir tank 5 is disposed below the ink tank 2. The reservoir tank 5 has a sealed structure. A lower end port of the first ink supply pipe 3 is disposed in the reservoir tank 5. Therefore, when the opening/closing valve 4 is opened, the ink liquid 1 in the ink tank 2 is supplied into the reservoir tank 5 through the first ink supply pipe 3 by a difference of elevation between the ink tank 2 and the reservoir tank 5.

A suction port of a second ink liquid supply pipe 6 is disposed in the reservoir tank 5. The suction port of the second ink liquid supply pipe 6 is immersed in the ink liquid 1. A supply port of the second ink liquid supply pipe 6 is connected to an ink distribution unit 7.

The ink distribution unit 7 is disposed in an intermediate height between installation heights of the ink tank 2 and the reservoir tank 5. The ink distribution unit 7 has a sealed structure. A plurality of ink heads 10 of the ink jet system are disposed below the ink distribution unit 7 via a plurality of ink inflow channels 8 and a plurality of sealing mechanisms 9. FIG. 1 shows one ink head 10 in consideration of complexity in drawing.

The ink head 10 has a plurality of nozzles arranged in a row in a lower surface of the ink head. The respective nozzles spout the ink liquids 1. An image forming medium 11 is conveyed in an arrow A direction under the ink head 10 at a predetermined speed. Therefore, when the ink liquids 1 spouted from the respective nozzles of the ink head 10 are shot on the image forming medium 11, an image is formed on the image forming medium 11.

When the ink liquids 1 are spouted from the nozzles of the ink head 10, a pressure in the ink distribution unit 7 drops. When the pressure in the ink distribution unit 7 drops, the ink liquid 1 in the reservoir tank 5 is supplied to the ink distribution unit 7 through the second ink liquid supply pipe 6.

Next, a constitution of a waste liquid system of the ink liquid 1 will be described.

In the ink head 10, there is a maintenance period in which the plurality of nozzles of the ink head 10 are cleaned. The plurality of nozzles are cleaned, when a wiper is slid with respect to a plurality of nozzle surfaces of the ink head 10. When the wiper is slid on the plurality of nozzle surfaces, the ink liquids 1 attached to the plurality of nozzle surfaces fall downwards. Therefore, an ink pan 12 is disposed under the ink head 10.

The ink pan 12 receives and accommodates droplets of the ink liquids 1 falling from the plurality of nozzles at the time of the cleaning of the ink head 10. The ink pan 12 has a tilting bottom surface. A first ink liquid discharge pipe 13 is disposed on a bottom surface of a lowermost position in the tilting bottom surface of the ink pan 12. The first ink liquid discharge pipe 13 is extended downwards from the tilting bottom surface of the ink pan 12, halfway curved, and connected to a waste liquid storage tank 14.

A head suction nozzle 15 is disposed under the ink head 10. The head suction nozzle 15 is provided with a second ink liquid discharge pipe 16. The second ink liquid discharge pipe 16 is halfway curved and connected to the waste liquid storage tank 14.

A suction chamber 17 is disposed on the second ink liquid discharge pipe 16. The suction chamber 17 is provided with a suction fan 18. Therefore, when the suction fan 18 rotates/operates, air is sucked from the head suction nozzle 15 through the suction chamber 17 and second ink liquid discharge pipe 16. When the head suction nozzle 15 sucks air, the head suction nozzle 15 sucks the ink liquids 1 adhering to the plurality of nozzle surfaces of the ink head 10. The ink liquid 1 sucked from the plurality of nozzle surfaces of the ink head 10 is sent into the waste liquid storage tank 14 through the second ink liquid discharge pipe 16.

It is to be noted that the suction in the plurality of nozzle surfaces of the ink head 10 is performed while pressurizing and spouting the ink liquid 1 into the ink head 10 from the plurality of nozzles.

One end port of an overflow liquid pipe 19 is disposed in the reservoir tank 5. The other end port of the overflow liquid pipe 19 is connected to an overflow tank 20. The overflow liquid pipe 19 is laid toward the overflow tank 20 from the reservoir tank 5 as follows. The overflow liquid pipe 19 is extended upwards from the upper surface of the reservoir tank 5, next curved, laid in a horizontal direction, next curved, extended downwards, and further extended into the overflow tank 20. The overflow liquid pipe 19 feeds the ink liquid 1 which has overflowed the reservoir tank 5 into the overflow tank 20.

The overflow tank 20 is disposed below an installation height of the reservoir tank 5. An atmosphere open tube 21 is connected between the overflow tank 20 and the ink distribution unit 7. The atmosphere open tube 21 is connected to an opening/closing valve 22. When the ink liquid 1 is supplied to the ink distribution unit 7 from the reservoir tank 5, the atmosphere open tube 21 opens the inside of the ink distribution unit 7 to the atmosphere through the opening/closing valve 22 and overflow tank 20.

The overflow tank 20 is connected to the overflow liquid pipe 19 and atmosphere open tube 21 of each ink path with respect to the ink liquid 1 of each of the colors of the black (K), cyan (C), magenta (M), and yellow (Y). Therefore, the overflow tank 20 accommodates the ink liquid 1 of each color which has overflowed the reservoir tank 5 of each color, and the inside of the ink distribution unit 7 of each color is opened to the atmosphere.

The overflow tank 20 is connected to an atmosphere open tube 23. The atmosphere open tube 23 is extended upwards from the upper surface of the overflow tank 20. An atmosphere open filter 24 is disposed on an upper end portion of the atmosphere open tube 23.

A waste liquid feed tube 25 is disposed on the side surface of the overflow tank 20. The waste liquid feed tube 25 is curved downwards and disposed. A discharge tube 26 is disposed on a lower end port of the waste liquid feed tube 25. The discharge tube 26 extends through the waste liquid storage tank 14. A discharge port 27 is disposed in an end portion of the discharge tube 26. The discharge port 27 has a one-way valve 28.

The waste liquid storage tank 14 is connected to the first and second ink liquid discharge pipes 13, 16. Therefore, the waste liquid storage tank 14 temporarily stores the waste liquids of the respective color ink liquids 1 of the black (K), cyan (C), magenta (M), and yellow (Y) in the plurality of ink heads 10, accommodated by the ink pan 12.

The bottom surface of the waste liquid storage tank 14 is connected to a waste liquid tank 30 via a waste liquid tube 29. The ink liquid 1 temporarily stored in the waste liquid storage tank 14 is supplied and stored as the waste liquid into the waste liquid tank 30.

A second opening/closing valve 35 is disposed between connection positions of the reservoir tank 5 and overflow tank 20 in the overflow liquid pipe 19.

One end of a pressurizing pipe 31 is connected between the connection position of the reservoir tank 5 and the second opening/closing valve 35. The other end of the pressurizing pipe 31 is connected to a pressurizing chamber 32. A pressurizing fan 33 is connected as a pressurizing machine to the pressurizing chamber 32.

A first opening/closing valve 34 is disposed between one end and the other end of the pressurizing pipe 31.

A liquid level sensor 36 is disposed on the side surface of the reservoir tank 5. The liquid level sensor 36 detects the liquid level height of the ink liquid 1 accommodated in the reservoir tank 5, and outputs a liquid level height detection signal S. For example, a float switch or a water level indicator is used in the liquid level sensor 36.

In one or both of a maintenance time of the ink head 10 and a periodic ink liquid removal time, an ink liquid removing control unit 37 feeds pressurized air into the overflow liquid pipe 19 through the pressurizing pipe 31, and spouts and removes the ink liquid 1 which has gotten into the overflow liquid pipe 19 on the side of at least the reservoir tank 5. In this case, the opening/closing valve 4 and the second opening/closing valve 35 have closed states, and the first opening/closing valve 34 has an opened state.

The ink liquid removal in which the ink liquid 1 is spouted and removed on the side of at least the reservoir tank 5 needs to be periodically performed.

When the inside of the reservoir tank 5 is pressurized, the ink liquid 1 is pressurized/supplied to the ink head 10 through the ink distribution unit 7, ink inflow channel 8, and sealing mechanism 9. Accordingly, the ink liquids 1 are spouted from the plurality of nozzles. In this case, the opening/closing valve 22 has a closed state.

The maintenance time of the ink head 10 is arbitrarily determined by a user. For example, the maintenance time of the ink head 10 may be preset, for example, immediately after activation of a power supply of the image forming apparatus.

A periodic ink liquid removal time in the overflow liquid pipe 19 is a time except the maintenance time and image forming operation time of the ink head 10.

An ink liquid removing operation is performed, for example, in a state in which the power supply of the image forming apparatus is activated, and in a standby state waiting for an image forming operation.

A concrete operation of the ink liquid removing control unit 37 is as follows.

The ink liquid removing control unit 37 sends a fan driving signal F to the pressurizing fan 33 to drive the pressurizing fan 33. In this state, the ink liquid removing control unit 37 sends a closing signal Hb to the second opening/closing valve 35, and thereafter sends an opening signal Ha to the first opening/closing valve 34 to open the valve only for an instant.

The ink liquid removing control unit 37 may feed the pressurized air to the overflow liquid pipe 19 through the pressurizing pipe 31 to remove the ink liquid 1 which has gotten into the overflow liquid pipe 19 at a desired time by user's operation irrespective of the maintenance time of the ink head 10 or the periodic ink liquid removal time.

The ink liquid removing control unit 37 inputs the liquid level height detection signal S output from the liquid level sensor 36, and judges whether or not the liquid level height of the ink liquid 1 in the reservoir tank 5 has reached a preset liquid level height. When the liquid level height of the ink liquid 1 reaches a preset liquid level height, the ink liquid removing control unit 37 sends the fan driving signal F to the pressurizing fan 33 to drive/control the pressurizing fan 33, and sends the closing signal Hb to the second opening/closing valve 35 in this state. Thereafter, the ink liquid removing control unit 37 sends the opening signal Ha to the first opening/closing valve 34 to open the valve only for an instant.

A valve control unit 38 sends an opening signal Ka or a closing signal Kb with respect to the respective opening/closing valves 4, 22 to open/close/control the opening/closing valves 4, 22. The valve control unit 38 inputs the liquid level height detection signal S output from the liquid level sensor 36, and sends the opening and closing signals Ka, Kb to the opening/closing valve 4 in accordance with the liquid level height in the reservoir tank 5.

Next, an operation of the image forming apparatus constituted as described above will be described.

The image forming operation with respect to the image forming medium 11 is as follows.

The ink liquid removing control unit 37 sends the closing signal Hb to the first opening/closing valve 34, and also sends the opening signal Ha to the second opening/closing valve 35. Accordingly, the first opening/closing valve 34 is brought into the closed state, and the second opening/closing valve 35 is brought into the opened state.

The valve control unit 38 sends the closing signals Kb to the opening/closing valves 4, 22. Accordingly, the respective opening/closing valves 4, 22 are brought into the closed state.

The image forming medium 11 is conveyed, for example, in an arrow A direction at a predetermined conveying speed.

When the ink head 10 spouts the ink liquid 1 in this state, the pressure in the ink distribution unit 7 lowers, and the ink liquid 1 is sucked up by the ink distribution unit 7 from the reservoir tank 5 through the second ink liquid supply pipe 6 by the amount of the ink liquid 1 spouted from the ink head 10. When the ink liquid 1 is sucked up into the ink distribution unit 7 from the reservoir tank 5, the liquid level height of the ink liquid 1 in the reservoir tank 5 lowers.

The liquid level sensor 36 detects the liquid level height of the ink liquid 1 in the reservoir tank 5, and outputs the liquid level height detection signal S.

The valve control unit 38 inputs the liquid level height detection signal S output from the liquid level sensor 36, judges that the liquid level height in the reservoir tank 5 has lowered, and sends the opening signal Ka to the opening/closing valve 4.

When the opening/closing valve 4 opens, the ink liquid 1 in the ink tank 2 is supplied into the reservoir tank 5 through the first ink supply pipe 3 by the difference of elevation between the ink tank 2 and the reservoir tank 5.

The valve control unit 38 inputs the liquid level height detection signal S output from the liquid level sensor 36, and judges whether or not the liquid level height in the reservoir tank 5 has risen to a predetermined liquid level height. When the liquid level height in the reservoir tank 5 rises to the predetermined liquid level height, the valve control unit 38 sends the closing signal Kb to the opening/closing valve 4.

The ink head 10 spouts the ink liquid 1 to the image forming medium 11 conveyed downwards from the plurality of nozzles. Accordingly, an image is formed on the image forming medium 11.

Maintenance with respect to the ink head 10 will be described.

The ink head 10 is cleaned in the maintenance time of the ink head 10. To perform the cleaning, the wiper is slid with respect to the lower surface of the ink head 10. The ink liquid 1 removed by the cleaning is collected in the ink pan 12. The ink liquid 1 collected in the ink pan 12 is fed into the waste liquid storage tank 14 through the first ink liquid discharge pipe 13.

In the maintenance time of the ink head 10, the head suction nozzle 15 is scanned with respect to the plurality of nozzle surfaces under the ink head 10. The head suction nozzle 15 sucks the ink liquid 1 adhering to the plurality of nozzle surfaces of the ink head 10. The sucked ink liquid 1 is fed into the waste liquid storage tank 14 through the second ink liquid discharge pipe 16.

It is to be noted that the maintenance is performed while pressurizing the ink liquids 1 to be supplied to the ink head 10 to thereby spout the ink liquids from the plurality of nozzles.

The ink liquid 1 into the ink head 10 is pressurized as follows. First, the valve control unit 38 sends the closing signals Kb to the opening/closing valves 4, 22. The ink liquid removing control unit 37 sends the closing signal Hb to the second opening/closing valve 35. Accordingly, the opening/closing valves 4, 22 and the second opening/closing valve 35 are brought into the closed states.

Next, the ink liquid removing control unit 37 sends the opening signal Ha to the first opening/closing valve 34. The first opening/closing valve 34 is brought into the opened state. The ink liquid removing control unit 37 sends the fan driving signal F to the pressurizing fan 33 to drive the pressurizing fan 33. The pressurized air generated by the driving of the pressurizing fan 33 pressurizes the inside of the reservoir tank 5 through the pressurizing chamber 32, pressurizing pipe 31, and first opening/closing valve 34. The ink liquid 1 pressurized in the reservoir tank 5 is supplied to the ink distribution unit 7 through the second ink liquid supply pipe 6. The inside of the ink distribution unit 7 is opened to the atmosphere through the atmosphere opening/closing valve 22. Accordingly, the pressurized ink liquid 1 is supplied to the ink head 10 from the ink inflow channel 8 through the sealing mechanism 9.

Therefore, the ink head 10 is maintained while sucking the ink liquids 1 spouted from the plurality of nozzles by the head suction nozzle 15. Moreover, the ink liquid 1 remaining halfway in the overflow liquid pipe 19 is removed.

Next, reasons why the ink liquid needs to be removed will be described with respect to the ink liquid 1 existing in the overflow liquid pipe 19.

The ink liquid 1 is supplied into the reservoir tank 5 from the ink tank 2 through the first ink supply pipe 3 and opening/closing valve 4 in a state in which the image forming apparatus does not perform the image forming operation.

The valve control unit 38 inputs the liquid level height detection signal S output from the liquid level sensor 36, and judges whether or not the liquid level height in the reservoir tank 5 has risen to the predetermined liquid level height. When the liquid level height in the reservoir tank 5 rises to the predetermined liquid level height, the valve control unit 38 sends the closing signal Kb to the opening/closing valve 4, and stops the supply of the ink liquid 1.

The ink liquid 1 is supplied into the reservoir tank 5 in the state in which the image forming apparatus performs the image forming operation as follows. The pressure of the ink distribution unit 7 lowers by consumption of the ink liquids 1 spouted from the plurality of nozzles of the ink head 10. Accordingly, the consumed amount of ink liquid 1 is sucked up into the ink distribution unit 7 from the reservoir tank 5.

When the liquid level height of the ink liquid 1 in the reservoir tank 5 lowers, the liquid level sensor 36 outputs the liquid level height detection signal S in lowering the liquid level.

On inputting the liquid level height detection signal S output from the liquid level sensor 36 and indicating the lowering of the liquid level, the valve control unit 38 sends the opening signal Ka to the opening/closing valve 4. Accordingly, the opening/closing valve 4 is brought into the opened state. The ink liquid 1 is replenished/supplied to the reservoir tank 5.

On the other hand, one end (inflow port 19*a*) of the overflow liquid pipe 19 is connected to an upper part of the reservoir tank 5, and the other end thereof is connected to the overflow tank 20 via the second opening/closing valve 35 which usually has the opened state.

When the liquid level height in the reservoir tank 5 rises to the predetermined liquid level height, for example, during the image forming operation, the valve control unit 38 sends the closing signal Kb to the opening/closing valve 4. At this time, when the liquid level height in the reservoir tank 5 rises to the predetermined liquid level height, and the closing signal Kb is sent to the opening/closing valve 4, a delay or the like is sometimes generated. In this case, the ink liquid 1 which has overflowed the reservoir tank 5 flows out on the side of the overflow tank 20.

Therefore, the overflow liquid pipe 19 needs to constantly keep the ink liquid 1 which has overflowed the reservoir tank 5 in a state capable of flowing out on the overflow tank 20 side.

Next, the periodic removal of the ink liquid 1 existing in the overflow liquid pipe 19 will be concretely described.

In the periodic ink liquid removal time, the ink liquid removing control unit 37 sends the fan driving signal F to the pressurizing fan 33, also sends the closing signal Hb to the second opening/closing valve 35, and thereafter sends the opening signal Ha to the first opening/closing valve 34 to open the valve only for an instant. Accordingly, the pressurizing fan 33 is driven, the second opening/closing valve 35 is closed, and the first opening/closing valve 34 is opened only for an instant in this state.

The pressurized air flows through the overflow liquid pipe 19 from the pressurizing pipe 31, and is applied into the reservoir tank 5. The ink liquid 1 existing in the overflow liquid pipe 19 is pressed by the pressurized air, discharged from the overflow liquid pipe 19, and returned into at least the reservoir tank 5. Moreover, the film of the ink liquid 1 formed on the inflow port 19*a* of the overflow liquid pipe 19 by surface tension or the like is blown/flown by the pressurized air.

The periodic ink liquid removal of the ink liquid 1 existing in the overflow liquid pipe 19 is performed, for example, in a state in which the power supply of the image forming apparatus is activated and in a standby state waiting for the image forming operation.

At the standby time of the image forming apparatus, the second opening/closing valve 35 is in the closed state.

For example, when the ink liquid 1 overflows the reservoir tank 5 for the above-described causes, the overflowed ink liquid 1 flows into the overflow tank 20 through the overflow liquid pipe 19. The ink liquid 1 which has overflowed the reservoir tank 5 does not all necessarily flow into the overflow tank 20. The ink liquid 1 which has overflowed the reservoir tank 5 sometimes remains in the middle of the overflow liquid pipe 19.

Especially, the ink liquid 1 sometimes remains between the inflow port 19*a* of the overflow liquid pipe 19 and the second opening/closing valve 35. The remaining ink liquid 1 needs to be removed also because the opening of the overflow liquid pipe 19 needs to be constantly secured.

In the maintenance time or the periodic ink liquid removal time of the ink head 10, the second opening/closing valve 35 is closed and the pressurizing fan 33 is driven. The pressurized air generated by the driving of the pressurizing fan 33 is sent into the reservoir tank 5 from the pressurizing pipe 31 through the overflow liquid pipe 19 continuously or like a pulse.

Accordingly, the ink liquid 1 remaining in the middle of the overflow liquid pipe 19 and the film of the ink liquid 1 formed on the inflow port 19*a* by the surface tension and the like.

Thus, according to the first embodiment, the overflow liquid pipe 19, which sends the ink liquid 1 overflowed the reservoir tank 5 to the overflow tank 20, is halfway branched, and the pressurizing pipe 31 is disposed. In the maintenance time of the ink head 10, and the periodic ink liquid removal time, the pressurized air generated by the driving of the pressurizing fan 33 is applied to the overflow liquid pipe 19 through the pressurizing pipe 31.

Accordingly, the ink liquid 1 remaining in the middle of the overflow liquid pipe 19 is pressed by the continuous or pulse-like pressurized air and discharged from the overflow liquid pipe 19.

The film of the ink liquid 1 formed on the inflow port 19*a* of the overflow liquid pipe 19 by the surface tension or the like is blown/flown and removed by the continuous or pulse-like pressurized air.

As a result, in an unusual time when the ink liquid 1 overflows the reservoir tank 5, the opening of the overflow liquid pipe 19, for feeding the ink liquid 1 into the overflow tank 20, can be constantly secured.

In the maintenance time of the ink head 10, the inside of the reservoir tank 5 is pressurized through the overflow liquid pipe 19 in the process of maintenance in the head suction nozzle 15 with respect to the ink head 10, the inside of the reservoir tank 5 is pressurized through the overflow liquid pipe 19. The ink liquid 1 remaining in the middle of the overflow liquid pipe 19, and the film of the ink liquid 1 formed on the inflow port 19*a* of the overflow liquid pipe 19 by the surface tension and the like are removed every time.

Therefore, since the pressurized air for the maintenance of the ink head 10 is also used in removing the ink liquid 1 of the overflow liquid pipe 19, any special mechanical tool does not have to be disposed, and the constitution can be simplified.

Next, a second embodiment of the present invention will be described with reference to the drawings.

Figure 2:
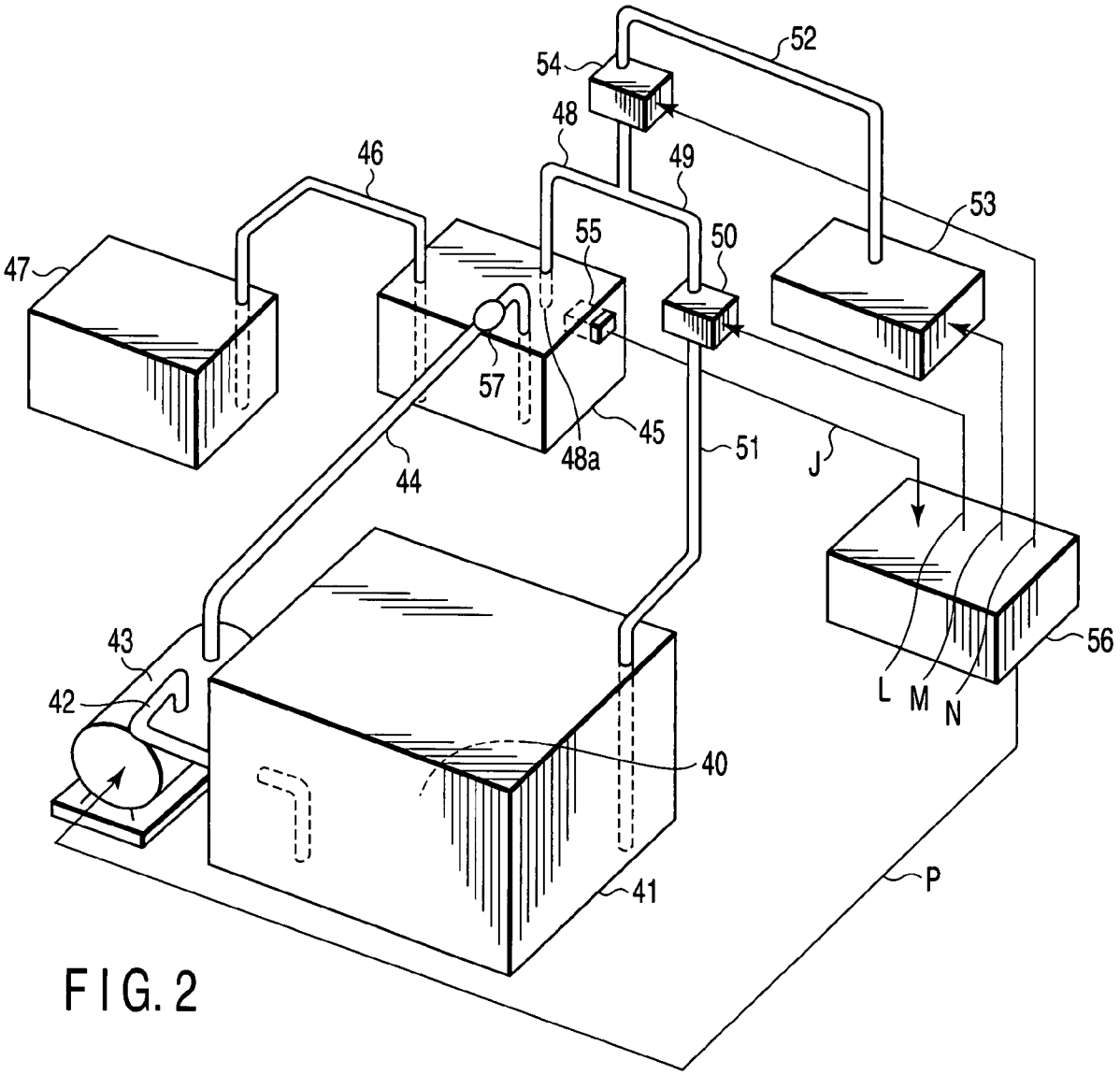
FIG. 2 is a constitution diagram showing a wet type semiconductor manufacturing apparatus to which a second embodiment of the liquid supply apparatus according to the present invention is applied.

FIG. 2 is a constitution diagram showing a wet type semiconductor manufacturing apparatus to which a second embodiment of the liquid supply apparatus according to the present invention is applied.

A chemical supply/recovery tank 41 accommodates a chemical solution 40. The chemical supply/recovery tank 41 is connected to a pump 43 via a first supply pipe 42. A discharge port of the pump 43 is connected to a second supply pipe 44. The pump 43 takes in the chemical solution 40 accommodated in the chemical supply/recovery tank 41 through the first supply pipe 42, and discharges the taken chemical solution 40 into the second supply pipe 44. A check valve 57 is disposed on the second supply pipe 44. The second supply pipe 44 is connected to a weighing tank 45 via the check valve 57.

The weighing tank 45 has a sealed structure.

The weighing tank 45 accommodates the chemical solution 40 supplied through the check valve 57 and the second supply pipe 44 by the pump 43. The weighing tank 45 is connected, for example, to a chemical tank 47 of the semiconductor manufacturing apparatus via a second supply pipe 46.

The weighing tank 45 supplies the weighed chemical solution 40, for example, to the chemical tank 47 of the semiconductor manufacturing apparatus through the second supply pipe 46.

One end port of a branch pipe 48 on a weighing tank side is disposed in the weighing tank 45. The weighing tank side branch pipe 48 extends upwards from the upper surface of the weighing tank 45, and is halfway curved and laid in a horizontal direction. The weighing tank side branch pipe 48 is halfway laid in the horizontal direction to constitute an opening/closing valve side branch pipe 49.

The opening/closing valve side branch pipe 49 extends in the horizontal direction, and is halfway curved and extended downwards. A second opening/closing valve 50 is disposed on the other end of the opening/closing valve side branch pipe 49, and the other end is connected to a recovery pipe 51 via the second opening/closing valve 50. The recovery pipe 51 is connected to the chemical supply/recovery tank 41.

One end of a pressurizing pipe 52 is disposed between the weighing tank side branch pipe 48 and the opening/closing valve side branch pipe 49. The other end of the pressurizing pipe 52 is connected to a pressurizing chamber 53. The pressurizing chamber 53 supplies the pressurized air to the pressurizing pipe 52.

The pressurizing chamber 53 has a pressurizing machine.

A first opening/closing valve 54 is disposed on the pressurizing pipe 52.

A liquid level sensor 55 is disposed on the side surface of the weighing tank 45. The liquid level sensor 55 detects the liquid level height of the chemical solution 40 accommodated in the weighing tank 45, and outputs a liquid level height detection signal J. For example, a float switch or a water level indicator is used in the liquid level sensor 55.

A chemical control unit 56 has a liquid removing section.

The liquid removing section of the chemical control unit 56 periodically feeds a pulse-like pressurized air to the weighing tank side branch pipe 48 and the opening/closing valve side branch pipe 49 through the pressurizing pipe 52, and removes the chemical solution 40 which has gotten into the weighing tank side branch pipe 48 and opening/closing valve side branch pipe 49. The liquid removing section of the chemical control unit 56 removes/controls the chemical solution 40 which has gotten into the weighing tank side branch pipe 48 and opening/closing valve side branch pipe 49 not only periodically but also in an arbitrary time set by the user.

The liquid removing section of the chemical control unit 56 may remove the chemical solution 40 which has gotten into the weighing tank side branch pipe 48 and opening/closing valve side branch pipe 49 not only periodically but also in a standby period of an etching process of, for example, a wafer in a semiconductor apparatus or during the etching process of the semiconductor wafer.

The liquid removing section of the chemical control unit 56 sends a pressurizing/driving signal M to the pressurizing chamber 53 to drive/control the pressurizing chamber 53, sends a closing signal L to the second opening/closing valve 50 in this state, and thereafter sends an opening signal N to the first opening/closing valve 54 to open the valve only for an instant.

The liquid removing section of the chemical control unit 56 inputs the liquid level height detection signal J output from the liquid level sensor 55. When the liquid level height of the chemical solution 40 in the weighing tank 45 reaches a preset liquid level height, the section sends the pressurizing/driving signal M to the pressurizing chamber 53 to drive/control the pressurizing chamber 53. In this state, the section sends the closing signal L to the second opening/closing valve 50, and thereafter sends the opening signal N to the first opening/closing valve 54 to open the valve only for an instant.

Next, an operation of the liquid supply apparatus constituted as described above will be described.

The chemical control unit 56 sends a driving signal P to the pump 43. When the pump 43 is driven, the pump 43 takes in the chemical solution 40 accommodated in the chemical supply/recovery tank 41 through the first supply pipe 42, and discharges the taken chemical solution 40 into the second supply pipe 44. The chemical solution 40 is supplied to the weighing tank 45 through the second supply pipe 44 and check valve 57.

The chemical control unit 56 inputs the liquid level height detection signal J output from the liquid level sensor 55, and judges whether or not the liquid level height of the chemical solution 40 in the weighing tank 45 has reached a preset liquid level height. When the liquid level height of the chemical solution 40 in the weighing tank 45 reaches the preset liquid level height, the chemical control unit 56 discontinues the sending of the driving signal P to the pump 43, and stops the driving of the pump 43.

Next, the chemical control unit 56 sends the closing signal L to the second opening/closing valve 50, and sends the opening signal N to the first opening/closing valve 54. Thereafter, the chemical control unit 56 sends the pressurizing/driving signal M to the pressurizing chamber 53. Accordingly, the pressure in the weighing tank 45 rises. By the pressure rise in the weighing tank 45, the chemical solution 40 in the weighing tank 45 is supplied to the chemical tank 47 through the second supply pipe 46.

Since the check valve 57 is disposed on the second supply pipe 44, back flow of the chemical solution 40 on a pump 43 side is prevented.

It is to be noted that chemical control unit 56 monitors time of the supply of the chemical solution 40 from the weighing tank 45 into the chemical tank 47 with a supply completion time known beforehand, and discontinues the supply into the chemical tank 47 after elapse of the time.

When the chemical solution 40 is supplied to the weighing tank 45, the chemical solution 40 sometimes overflows the weighing tank 45, for example, by an erroneous operation of the liquid level sensor 55 or the like. Therefore, the second opening/closing valve 50 is usually brought into the opened state, and the chemical solution 40 which has overflowed the weighing tank 45 is recovered into the chemical supply/recovery tank 41 through the weighing tank side branch pipe 48, opening/closing valve side branch pipe 49, and recovery pipe 51.

All the chemical solution 40 that has overflowed the weighing tank 45 does not necessarily flows into the chemical supply/recovery tank 41. The chemical solution 40 which has overflowed the weighing tank 45 sometimes remains in the middle of the weighing tank side branch pipe 48 and opening/closing valve side branch pipe 49.

Especially, the chemical solution 40 sometimes remains between an inflow port 48*a* of the weighing tank side branch pipe 48 and the second opening/closing valve 50. The remaining chemical solution 40 needs to be removed also because the opening from the weighing tank side branch pipe 48 through the opening/closing valve side branch pipe 49 needs to be constantly secured.

A film of the chemical solution 40 is sometimes formed on the inflow port 48*a* of the weighing tank side branch pipe 48 by the surface tension or the like.

The liquid removing section of the chemical control unit 56 periodically sends the closing signal L to the second opening/closing valve 50, and then sends the pressurizing/driving signal M to the pressurizing chamber 53. In this state, the liquid removing section of the chemical control unit 56 sends the opening signal N to the first opening/closing valve 54 only for an instant.

Accordingly, the pressurizing chamber 53 supplies the pressurized air to the pressurizing pipe 52. The pressurized air fed from the pressurizing chamber 53 is applied to the first opening/closing valve 54 through the pressurizing pipe 52. In this case, since the second opening/closing valve 50 is in the closed state, the first opening/closing valve 54 is opened only for an instant, and accordingly the pulsed pressurized air passes through the weighing tank side branch pipe 48 and opening/closing valve side branch pipe 49 via the first opening/closing valve 54, and is discharged from the inflow port 48*a* of the weighing tank side branch pipe 48.

Accordingly, the chemical solution 40 remaining in the middle of the weighing tank side branch pipe 48 and opening/closing valve side branch pipe 49 is pressed by the pulsed pressurized air, and discharged from the weighing tank side branch pipe 48. Moreover, the film of the chemical solution 40 formed on the inflow port 48*a* of the weighing tank side branch pipe 48 by the surface tension or the like is blown/flown by the pulsed pressurized air.

Thus, according to the second embodiment, the pressurizing pipe 52 is disposed between the weighing tank side branch pipe 48 and opening/closing valve side branch pipe 49 to recover the chemical solution 40 which has overflowed the weighing tank 45 in the chemical supply/recovery tank 41. The pressurized air from the pressurizing chamber 53 is applied to the weighing tank side branch pipe 48 and opening/closing valve side branch pipe 49 through the pressurizing pipe 52.

Accordingly, the chemical solution 40 which has gotten into the weighing tank side branch pipe 48 and opening/closing valve side branch pipe 49 and which remains in the middle is pressed by the pulsed pressurized air, and discharged from the inflow port 48*a* of the weighing tank side branch pipe 48.

The film of the chemical solution 40 formed on the inflow port 48*a* of the weighing tank side branch pipe 48 by the surface tension or the like is blown/flown and removed by the pulsed pressurized air.

As a result, the opening of the weighing tank side branch pipe 48 and opening/closing valve side branch pipe 49 for recovering the chemical solution 40 in the chemical supply/recovery tank 41 can be constantly secured at an unusual time when the chemical solution 40 overflows the weighing tank 45.

When the chemical solution 40 is supplied into the chemical tank 47 from the weighing tank 45, the inside of the weighing tank 45 is pressurized through the weighing tank side branch pipe 48 and opening/closing valve side branch pipe 49 in the process of the supply of the chemical solution 40 from the weighing tank 45 to the chemical tank 47. Accordingly, the chemical solution 40 remaining in the middle of the weighing tank side branch pipe 48 and opening/closing valve side branch pipe 49, and the film of the chemical solution 40 formed on the inflow port 48*a* of the weighing tank side branch pipe 48 by the surface tension or the like are removed every time.

Therefore, since the pressurized air at the time of the supply from the weighing tank 45 into the chemical tank 47 is also used in removing the chemical solution 40 remaining in the middle of the weighing tank side branch pipe 48 and opening/closing valve side branch pipe 49, any special mechanical tool does not have to be disposed, and the constitution can be simplified.

The present invention is not limited to the application of the image forming apparatus of the ink jet system and the wet type semiconductor manufacturing apparatus. The present invention can be applied to any apparatus provided with the liquid removing section which is provided with the overflow liquid pipe to pass the liquid overflowed the first container through the second container and which pressurizes the inside of the overflow liquid pipe through the pressurizing pipe to remove the liquid existing in the overflow liquid pipe.

The present invention is not limited to the above-described embodiments, and it may be modified as follows.

In the first embodiment, the ink liquid 1 in the ink tank 2 is supplied into the reservoir tank 5 by the difference of elevation between the ink tank 2 and the reservoir tank 5. This is not restrictive, and the ink liquid 1 in the ink tank 2 may be supplied into the reservoir tank 5 by the pump.

In the second embodiment, the chemical solution 40 in the chemical supply/recovery tank 41 is supplied into the weighing tank 45 by the pump 43. This is not restrictive, and the chemical solution 40 in the chemical supply/recovery tank 41 may be supplied to the weighing tank 45 utilizing the difference of elevation between the chemical supply/recovery tank 41 and the weighing tank 45.

In the second embodiment, the chemical solution 40 is supplied into the chemical tank 47 from the weighing tank 45, while the inside of the weighing tank 45 is pressurized. This is not restrictive, and an opening/closing valve may be disposed in the middle of the second supply pipe 46 between the weighing tank 45 and the chemical tank 47, and the chemical solution may be supplied into the chemical tank 47 utilizing the difference of elevation between the weighing tank 45 and the chemical tank 47.

In the second embodiment, the check valve 57 is disposed on the first supply piping 44 between the chemical supply/recovery tank 41 and the weighing tank 45. This is not restrictive, and an opening/closing valve may be disposed instead of the check valve 57.

What is claimed is:

1. A liquid supply apparatus, which supplies an ink liquid to an ink head that spouts the ink liquid to an image forming medium, the apparatus comprising:

an ink tank which accommodates the ink liquid;

a reservoir tank which receives the ink liquid supplied from the ink tank to accommodate the ink liquid;

an ink distribution unit which receives the ink liquid supplied from the reservoir tank and supplies the ink liquid to the ink head;

an overflow liquid pipe having a first end connected to the reservoir tank, and a second end;

an overflow tank which is connected to the second end of the overflow liquid pipe to collect the ink liquid that has flowed through the overflow liquid pipe from the reservoir tank, and which opens the reservoir tank to the atmosphere through the overflow liquid pipe;

a pressurizing pipe connected to the overflow liquid pipe; and an ink liquid removing unit to pressurize an interior of the overflow liquid pipe through the pressurizing pipe and to remove the ink liquid which stays in the overflow liquid pipe.

2. The liquid supply apparatus according to claim 1, wherein the ink liquid removing unit pressurizes the interior of the overflow liquid pipe through the pressurizing pipe at a time of a maintenance operation on the ink head.

3. The liquid supply apparatus according to claim 1, wherein the ink liquid removing unit comprises a pressurizing machine which feeds pressurized air into the overflow liquid pipe through the pressurizing pipe.

4. The liquid supply apparatus according to claim 3, wherein the pressurizing machine has a pressurizing fan.

5. The liquid supply apparatus according to claim 1, wherein the ink liquid removing unit comprises:

a first opening/closing valve disposed on the pressurizing pipe;

a pressurizing machine which feeds pressurized air to the overflow liquid pipe through the pressurizing pipe;

a second opening/closing valve disposed on the overflow liquid pipe; and an ink liquid removing control unit which drives/controls the pressurizing machine and the first and second opening/closing valves, respectively.

6. The liquid supply apparatus according to claim 5, wherein the second opening/closing valve is disposed between a connection position at which the pressurizing pipe is connected to the overflow liquid pipe, and the overflow tank.

7. The liquid supply apparatus according to claim 5, wherein the ink liquid removing control unit drives/controls the pressurizing machine and the first and second opening/closing valves, respectively, at a time of a maintenance operation on the ink head.

8. The liquid supply apparatus according to claim 5, wherein the ink liquid removing control unit closes the first and second opening/closing valves in a state in which the pressurizing machine feeds the pressurized air to the overflow liquid pipe through the pressurizing pipe, and thereafter opens the first opening/closing valve for only an instant.

9. The liquid supply apparatus according to claim 8, wherein the ink liquid removing control unit opens the first opening/closing valve only at the instant, and applies pulsed pressurized air to the overflow liquid pipe.

10. The liquid supply apparatus according to claim 5, wherein when the ink liquid removing control unit opens the first opening/closing valve and closes the second opening/closing valve, and the pressurizing machine feeds the pressurized air to the overflow liquid pipe through the pressurizing pipe, the ink liquid in the reservoir tank is supplied into the ink head through the ink distribution unit, and is forcibly discharged from the ink head.

11. The liquid supply apparatus according to claim 1, further comprising:

a liquid level sensor which detects a liquid level height of the ink liquid accommodated in the reservoir tank; and an ink liquid removing control unit which controls the ink liquid removing unit to remove the ink liquid staying in the overflow liquid pipe, when the liquid level height in the reservoir tank, detected by the liquid level sensor, reaches a preset liquid level height.

12. The liquid supply apparatus according to claim 11, wherein the liquid level sensor comprises one of a water level indicator and a float switch.

13. The liquid supply apparatus according to claim 1, wherein the ink liquid removing unit pressurizes the interior of the overflow liquid pipe through the pressurizing pipe periodically.

14. The liquid supply apparatus according to claim 1, wherein the ink liquid removing unit pressurizes the interior of the overflow liquid pipe through the pressurizing pipe for only a moment of time.

15. A liquid supply apparatus which supplies ink liquids of different colors to a plurality of ink heads that correspond to the different colors, respectively, and that spout the ink liquids to an image forming medium, the apparatus comprising:

a plurality of ink tanks which accommodate the ink liquids of the different colors;

a plurality of reservoir tanks which receive the respective ink liquids supplied from the plurality of ink tanks to accommodate the respective ink liquids;

a plurality of ink distribution units which receive the respective ink liquids supplied from the plurality of reservoir tanks;

a plurality of overflow liquid pipes having first ends which are respectively connected to the plurality of reservoir tanks, and second ends;

an overflow tank which is connected to the second ends of the plurality of overflow liquid pipes to collect the respective ink liquids that have flowed through the plurality of overflow liquid pipes from the plurality of reservoir tanks, and which opens the plurality of reservoir tanks to the atmosphere through the plurality of overflow liquid pipes;

a plurality of pressurizing pipes having first ends that are connected to middle portions of the plurality of overflow liquid pipes;

a pressurizing chamber connected to second ends of the plurality of pressurizing pipes;

a pressurizing machine connected to communicate with the pressurizing chamber;

a plurality of first opening/closing valves disposed on middle portions of the plurality of pressurizing pipes, respectively;

a plurality of second opening/closing valves disposed on middle portions of the overflow liquid pipes, respectively; and an ink liquid removing control unit which drives/controls the pressurizing machine, selects the plurality of first and second opening/closing valves, and controls opening and closing of the plurality of first and second opening/closing valves.

* * * * *